US011175119B2

(12) United States Patent
Patching

(10) Patent No.: US 11,175,119 B2
(45) Date of Patent: Nov. 16, 2021

(54) METHOD AND APPARATUS FOR PREVENTING ROCK FRAGMENTS FROM ENTERING OR COLLAPSING INTO A BLAST HOLE

(71) Applicant: TBS MINING SOLUTIONS PTY LTD, Mount Pleasant (AU)

(72) Inventor: Gregory Patching, Attadale (AU)

(73) Assignee: TBS Mining Solutions Pty Ltd., Mount Pleasant (AU)

( * ) Notice: Subject to any disclaimer, the term of this patent is extended or adjusted under 35 U.S.C. 154(b) by 0 days.

(21) Appl. No.: 16/632,836

(22) PCT Filed: Jul. 18, 2018

(86) PCT No.: PCT/AU2018/050752
§ 371 (c)(1),
(2) Date: Jan. 21, 2020

(87) PCT Pub. No.: WO2019/014716
PCT Pub. Date: Jan. 24, 2019

(65) Prior Publication Data

US 2020/0149854 A1 May 14, 2020

(30) Foreign Application Priority Data

Jul. 19, 2017 (AU) ..... 2017902834
Aug. 4, 2017 (AU) ..... 2017903102
(Continued)

(51) Int. Cl.
*F42D 1/22* (2006.01)
*F42D 3/04* (2006.01)

(52) U.S. Cl.
CPC *F42D 1/22* (2013.01); *F42D 3/04* (2013.01)

(58) Field of Classification Search
CPC ..... F42D 1/22; F42D 3/04
(Continued)

(56) References Cited

U.S. PATENT DOCUMENTS 1,380,182 A 5/1921 Bigelow
3,177,945 A 4/1965 Fether
(Continued)

FOREIGN PATENT DOCUMENTS

AU 6450499 A1 8/2000
AU 199964504 A1 8/2000
(Continued)

OTHER PUBLICATIONS

ISA/AU, International Search Report and Written Opinion, dated Oct. 2, 2018, re PCT International Patent Application No. PCT/AU2018/050752.

(Continued)

*Primary Examiner* — Bret Hayes
(74) *Attorney, Agent, or Firm* — Millen, White, Zelano & Branigan, P.C.; William Nixon

(57) ABSTRACT

The invention provides an apparatus and method for preventing surrounding loose rock fragments from falling or collapsing into a blast hole. The apparatus includes a flexible sheet including a pair of spaced apart longitudinally extending side edges and a pair of spaced apart laterally extending end edges. The sheet has a curved form defining a longitudinal passage extending between openings at longitudinally opposite ends, one end of the curved sheet being insertable into the open end of a blast hole whereby the curved sheet closely faces an internal surface of the blast hole and forms a barrier preventing surrounding loose rock fragments from falling or collapsing into the open end of the blast hole. The
(Continued)

invention also provides a bench blasting method and a deployment device for deploying the apparatus into a blast hole.

7 Claims, 5 Drawing Sheets

(30) Foreign Application Priority Data

Aug. 18, 2017 (AU) ..... 2017903341
Dec. 4, 2017 (AU) ..... 2017904880

(58) Field of Classification Search
USPC ..... 10/303, 313, 321, 324
See application file for complete search history.

(56) References Cited

U.S. PATENT DOCUMENTS

| | | | | |
|---|---|---|---|---|
| 3,208,381 | A * | 9/1965 | Kihlstrom | F42D 1/22 102/333 |
| 3,275,081 | A | 9/1966 | Beylik | |
| 3,330,361 | A | 7/1967 | McCullough | |
| 3,696,703 | A * | 10/1972 | Fox | F42D 1/10 86/20.15 |
| 4,055,122 | A | 10/1977 | Muldrow, Jr. | |
| 4,182,414 | A | 1/1980 | Sanders et al. | |
| 4,501,327 | A * | 2/1985 | Retz | E21B 17/00 138/98 |
| D279,352 | S | 6/1985 | Mitchell et al. | |
| 6,886,466 | B2 * | 5/2005 | Senules | E21B 43/101 102/313 |
| 7,861,787 | B2 | 1/2011 | Russell | |
| 7,950,328 | B2 * | 5/2011 | Howerton | F42D 1/08 102/319 |
| D671,960 | S | 12/2012 | Kirk et al. | |
| 8,800,650 | B2 | 8/2014 | Spray et al. | |
| 9,303,493 | B2 | 4/2016 | Hagen | |
| 9,617,802 | B2 | 4/2017 | Lastra | |
| 2001/0039711 | A1 | 11/2001 | Donnelly et al. | |
| 2004/0200373 | A1 * | 10/2004 | Robert | F42D 3/04 102/313 |
| 2009/0101363 | A1 | 4/2009 | Teixeira | |
| 2009/0279960 | A1 * | 11/2009 | Hazzan | E02D 5/64 405/233 |
| 2013/0068478 | A1 | 3/2013 | Allen et al. | |

FOREIGN PATENT DOCUMENTS

| | | |
|---|---|---|
| CN | 201476724 U | 5/2010 |
| CN | 203704813 U | 7/2014 |

OTHER PUBLICATIONS

IPEA/AU, International Preliminary Report on Patentability (Ch II), dated Jul. 8, 2019, re PCT International Patent Application No. PCT/AU2018/050752.

Anonymous, Benchsaver Specifications, downloaded from the internet on Feb. 1, 2019 from http://www.mtigroup.com.au/benchsaver.html, MTI Group, Wangara, AU (Publ), (2 pages).

Anonymous, Collar, Blast Training International Glossary, downloaded from the internet on Feb. 14, 2019 from http://online.blasttraining.com.au/mod/glossary/view.php?id=40&mode=&hook=all&sortkey=&sortorder=&fullsearch=0&page=-1.

Anonymous, Ecocones, downloaded from the internet on May 17, 2018 from http://americanblasting.co/products/ecocones, American Blasting Technology, Sour Lake, TX (Publ)(1 page).

* cited by examiner

METHOD AND APPARATUS FOR PREVENTING ROCK FRAGMENTS FROM ENTERING OR COLLAPSING INTO A BLAST HOLE

CROSS REFERENCE TO RELATED APPLICATIONS

This application is a continuation under 35 U.S.C. § 371 of International Application No. PCT/AU2018/050752 filed on Jul. 18, 2018, which claims priority to and the benefit of, Australian Patent Application No. 2017902834 filed on Jul. 19, 2017, Australian Patent Application No. 2017903102 filed on Aug. 4, 2017, Australian Patent No. 2017903341 filed in Aug. 18, 2017 and Australian Patent Application No. 2017904880 filed on Dec. 4, 2017, the entire contents of each are incorporated by reference herein.

TECHNICAL FIELD

The present invention relates to the field of blasting, particularly in the fields of mining and quarrying.

BACKGROUND

Minerals such as iron ore and coal can be recovered in a variety of methods including above ground open cut mining methods. Such methods can involve the use of blasting with bulk explosives to dislodge bulk quantities of ore for excavation and recovery through subsequent handling via excavators and the like. The blasting process results in the comminution of rock containing the ore into particles of varying sizes. It is desirable for the blasting process to produce material with an average particle size that is as small as possible to minimise the need for further comminution by crushing, grinding, vibrating and other processes.

Bench blasting is a process that involves drilling holes into rock at depths, in diameters, and at spacing and filing the holes with explosive material to form a column charge that fractures the rock in a controlled manner. The blasting holes can have diameters as large as 270 to 311 or even up to 350 millimetres and larger and have depths of as much as 50 metres or more. These blast holes are filled with bulk explosive materials that are, at least in part, ammonium nitrate based low velocity explosives. The explosive material will be contacted with a primer and covered or "stemmed" with material such as aggregate. The primer is activated electrically or non-electrically to cause the explosive to detonate.

Most of the rock that is fractured after a blasting operation is removed from the site by excavators for further processing or waste removal. However, significant quantities of loose rock fragments, or "preconditioned" material, can remain on the bench from the sub-drilled region after achieving the Reduced Level (RL). It can be desirable to employ substantially increased sub-drill lengths to deliberately and significantly increase the depth of the preconditioned layer. A preconditioned layer depth of up to 4 metres or more can improve the efficiency of the comminution process by maximising the volume of fine fragmentation that results from the subsequent blasting operation.

In the location where blast holes for a subsequent blasting operation are to be drilled these fragments or 'preconditioned' material remain. After blast holes have been drilled loose rock fragments or preconditioned material can collapse into the openings of completed blast holes to partially fill or even block the drill hole prior to depositing explosive material. Where up to the first four or more metres of the depth of the blast hole can be through the preconditioned layer the risk of material collapsing into blast holes can be acute. Wet environments may also lubricate the loose rock fragments, exacerbating the collapsing of loose rock fragments into the blast holes.

Any discussion of background art throughout the specification should in no way be considered as an admission that any of the documents or other material referred to was published, known or forms part of the common general knowledge.

SUMMARY OF THE INVENTION

Accordingly, in one aspect, the invention provides an apparatus for preventing surrounding loose rock fragments from falling or collapsing into a blast hole, the apparatus including: a resiliently flexible sheet including a pair of spaced apart longitudinally extending side edges and a pair of spaced apart laterally extending end edges, the sheet having a curved form defining a longitudinal passage extending between openings at longitudinally opposite ends, one end of the curved sheet being insertable into the open end of a blast hole, wherein in the curved form the side edges of the sheet are free and the sheet biases towards a flat form whereby an external surface of the curved sheet is biased against an internal surface of the blast hole and forms a barrier preventing surrounding loose rock fragments from falling or collapsing into the blast hole.

Preferably, the sheet is adapted to be forced into a substantially cylindrical or a conical form wherein upon insertion through the open end of a blast hole the sheet assumes a substantially cylindrical form coaxially within the blast hole. Preferably, the sheet is adapted to be manipulated manually into the cylindrical or the conical form.

In accordance with the invention, the sheet is formed of resiliently flexible material biased towards a substantially flat form whereby in use within the blast hole the sheet biases against the internal surface of the blast hole. Advantageously, the resilient properties of the material from which the sheet is formed cause the external surface of the sheet to be biased against the internal surface of the blast hole thereby forming a barrier preventing surrounding loose rock fragments from falling or collapsing into the blast hole.

In embodiments, the longitudinally extending side edges taper at an end thereof. When the sheet is bent over on itself, manually or otherwise, and the transversely opposite parallel edges are brought towards each other the tapering of the ends of the side edges to promote a more uniform cylindrical form of the sheet.

In embodiments, the width of the sheet between the longitudinally extending side edges is less than the circumference of the blast hole. Preferably, the sheet is adapted to assume a substantially cylindrical form within the blast hole wherein the side edges of the sheet are spaced apart. Preferably, the sheet is adapted to be forced, such as by being manually manipulated, into the cylindrical form. Alternatively, the sheet may be mechanically manipulated into the cylindrical form. In embodiments, the width of the sheet between the longitudinally extending side edges is equal to the circumference of the blast hole or is greater than the circumference of the blast hole. It is to be appreciated that a width less than the circumference of the blast hole is preferred as this allows for distortion and non-uniformity of the blast hole and also requires fewer openings in the sheet for use as hand holds thus minimising any weakening of the sheet. However, the embodiments of the sheet where the width of the sheet is equal to or greater than the circumference of the blast hole also fulfils the broad objectives of the invention which is to form a barrier preventing surrounding loose rock fragments from falling or collapsing into the blast hole.

In embodiments, the longitudinally extending side edges taper at an end thereof. When the sheet is bent over on itself and the transversely opposite parallel edges are brought towards each other the tapering of the ends of the side edges promotes a more uniform cylindrical form for the sheet.

Preferably, the longitudinally extending side edges each include elongated flanges adapted for abutment with each other when the sheet is in the curved form.

In embodiments, the flexible sheet is comprised of a substantially flat sheet of flexible material. The flexible sheet has a normally flat form and is adapted to be rolled into the curved form. That is, in the resting state, the sheet will tend towards a substantially flat form.

In embodiments, the sheet includes at least one opening through the sheet adjacent to each longitudinally extending side edge operable as a hand hold for a user to manually roll the sheet into the curved form. In embodiments embodiment, the sheet includes at least one opening through the sheet adjacent to one of the end edges operable as a hand hold for a user to manually insert and remove the sheet relative to the open end of a blast hole.

In embodiments, the sheet includes a pair of openings through the sheet that are adapted to receive therethrough an elongated member for engaging a surface surrounding the blast hole to prevent further insertion of the panel through the opening of the blast hole. Preferably, the pair of openings are located adjacent to each longitudinally extending side edge and are aligned with each other along the length of the sheet for receiving the longitudinal member therethrough perpendicularly to the length of the sheet.

In another aspect, the invention provides a method for preventing surrounding loose rock fragments from falling or collapsing into a blast hole, the method including: providing a resiliently flexible sheet including a pair of spaced apart longitudinally extending side edges and a pair of spaced apart laterally extending end edges, forming the sheet into a curved form defining a longitudinal passage extending between openings at longitudinally opposite ends, inserting one end of the curved sheet into the open end of a blast hole wherein in the curved form the side edges of the sheet are free and the sheet biases towards a flat form whereby an external surface of the curved sheet biases against an internal surface of the blast hole and substantially coaxially therewith forming a barrier preventing surrounding loose rock fragments from falling or collapsing into the blast hole.

Preferably, the method includes locating the sheet within the blast hole within a layer of preconditioned loose rock fragments to form a barrier preventing the internal surface of the blast hole within the preconditioned layer from falling or collapsing into the blast hole. Preferably, the method can include inserting an elongated member through apertures in the sheet whereby the elongated member engages a surface surrounding the blast hole to prevent further insertion of the sheet through the open end of the blast hole.

In an embodiment, the method includes: forcing the flexible sheet into a conical form tapering in an axial direction from a larger diameter opening at one of the ends to a smaller diameter opening at the other end, inserting the smaller diameter end through the open end of a blast hole, and releasing the sheet to assume a substantially cylindrical form within the blast hole thereby forming a barrier preventing surrounding loose rock fragments from falling or collapsing into the blast hole.

In another embodiment, the method includes: forcing the flexible sheet into a cylindrical form and inserting the sheet through the open end of a blast hole and releasing the sheet whereby the sheet biases against the internal surface of the blast hole forming a barrier preventing surrounding loose rock fragments from falling or collapsing into the blast hole.

Preferably, the method includes forcing the sheet manually into the conical or the cylindrical form. Alternatively, the method may include mechanically forcing the sheet into the conical or the cylindrical form.

Embodiments of the apparatus and method are advantageous in that they provide convenient installation of a barrier in the open end of a blast hole that prevents surrounding loose rock fragments from falling or collapsing into the blast hole.

Embodiments of the apparatus and method are advantageous in that they operate to maintain an open collar for the blast hole to enable ease in depositing typical explosives and other consumables into the blast hole.

In another aspect, the invention provides a bench blasting method including: drilling blast holes through a layer of preconditioned loose rock fragments and into the stable rock below; forming a substantially flat resiliently flexible sheet into a curved form defining a longitudinal passage and openings at longitudinally opposite ends, inserting one end of the curved sheet into an open end of the blast hole wherein in the curved form the side edges of the sheet are free and the resilient sheet biases towards a flat form whereby an external surface of the curved sheet biases against an internal surface of the blast hole within the layer of preconditioned loose rock fragments and forms a barrier preventing the internal surface of the blast hole within the preconditioned layer from falling or collapsing into the blast hole.

Preferably, the method includes forcing the flexible sheet into a conical form tapering in an axial direction from a larger diameter opening at one of the ends to a smaller diameter opening at the other end, inserting the smaller diameter end through the open end of a blast hole, and releasing the sheet to assume a substantially cylindrical form within the blast hole. In another embodiment, the method includes forcing the flexible sheet into a cylindrical form and inserting the sheet through the open end of a blast hole and releasing the sheet whereby the sheet biases against the internal surface of the blast hole.

Preferably, the method includes forcing the sheet manually into the conical or the cylindrical form. Alternatively, the method may include mechanically forcing the sheet into the conical or the cylindrical form.

Preferably, the sheet has a longitudinal length dimension that is 1 metre, 1.5 metres, 2 metres, 2.5 metres, 3 metres, 3.5 metres, 4 metres or more or any length therebetween as determined by geological requirements. Preferably, the method includes inserting the curved sheet into the open end of the blast hole whereby the curved sheet closely faces an internal surface of the blast hole down to a depth of about 1 metre, about 1.5 metres, about 2 metres, about 2.5 metres, about 3 metres, about 3.5 metres, about 4 metres or more or any depth therebetween within the layer of preconditioned loose rock fragments as determined by geological requirements.

In another aspect, the invention provides a deployment device for deploying into a blast hole an apparatus for preventing surrounding loose rock fragments from falling or collapsing into the blast hole, the device including a forming apparatus adapted to form a flat flexible sheet into a curved form for insertion into the open end of a blast hole whereby the curved sheet closely faces an internal surface of the blast hole forming a barrier preventing surrounding loose rock fragments from falling or collapsing into the blast hole.

Preferably, the forming apparatus includes a shaped passage adapted to form the sheet into the curved form as the sheet moves through the passage.

In an embodiment, the shaped passage includes a wide opening at the top and side walls tapering towards a narrower bottom outlet.

Preferably, the deployment device includes a store of a plurality of the sheets arranged in a stack. The deployment device preferably includes a sheet picker and feeder that is operable to pick an individual sheet from the stack and feed the sheet through the shaped passage.

BRIEF DESCRIPTION OF THE FIGURES

The present invention will now be described in more detail with reference to preferred embodiments illustrated in the accompanying figures, wherein:

FIG. 4 illustrates a front view of the apparatus of FIG. 1, wherein opposite substantially parallel edges of the sheet are closely spaced from each other and wherein an elongated member is inserted through horizontally aligned openings in the cylindrical apparatus for engaging a surface surrounding the blast hole to prevent further insertion of the sheet through the opening of the blast hole;

The invention will now be described in further detail with reference to the embodiments illustrated in the Figures.

DETAILED DESCRIPTION

Figure 1:
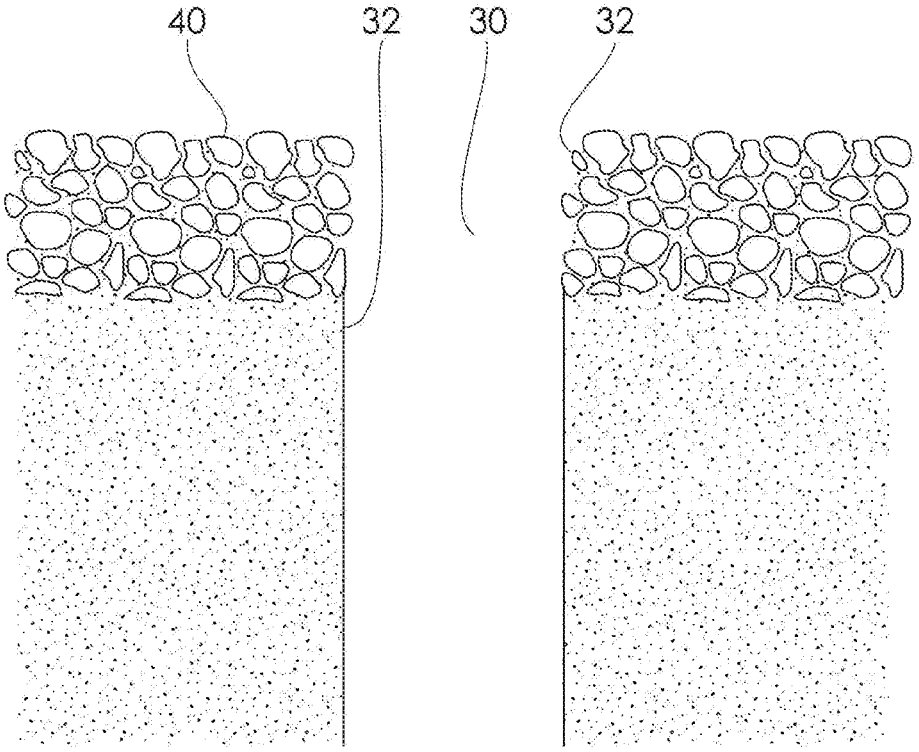
FIG. 1 illustrates a perspective view of an apparatus for preventing surrounding loose rock fragments from falling into a blast hole, wherein the apparatus includes a resiliently flexible substantially rectilinear sheet having pair of opposite substantially parallel edges.

Referring to FIGS. 1 to 5, there is shown an embodiment of the invention comprising an apparatus 10 that, in use, is adapted for preventing surrounding loose rock fragments 40 from falling or collapsing into a blast hole 30. In FIG. 1 a frontal section of an open end of a single blast hole 30 is illustrated although it is to be appreciated that a multitude of such blast holes 30 would be drilled for a single blasting operation. The blast hole 30 can be drilled with a diameter as large as 270 to 311 millimetres or as much as 350 millimetres or more and to depths of as much as 50 metres or more. After drilling, the blast hole 30 is filled with explosive material appropriate for the ground conditions, such as a mixture of ammonium nitrate and fuel oil (ANFO) or an emulsion or a mixture thereof and is primed for detonation.

Most of the rock that is fragmented after a blasting operation is removed from a mine site by excavators for further processing or waste removal. However, significant quantities of loose rock fragments or "preconditioned" rock fragments can remain on the mine bench from the sub-drilled region after achieving the Reduced Level (RL). It can be desirable to employ substantially increased sub-drill lengths to deliberately and significantly increase the depth of the preconditioned layer. A preconditioned layer depth of up to 4 metres or more can improve the efficiency of the comminution process by maximising the volume of fine fragmentation that results from the subsequent blasting operation. In the location where blast holes for a subsequent blasting operation are to be drilled these preconditioned rock fragments remain. As shown in FIG. 1, the blast hole 30 comprises an open upper end 33 which is surrounded by a layer of preconditioning comprised of loose rock fragments 40. The layer of preconditioned rock fragments 40 can have a depth of up to 4 or more metres. As such, up to the first 4 or more metres of the depth of the blast hole 30 below the upper open end 33 can be through the preconditioned layer of loose rock fragments 40. A quantity of the loose rock fragments 40 can collapse into the blast hole 30 at or towards the open upper end 33 of the blast hole 30.

Figure 2:
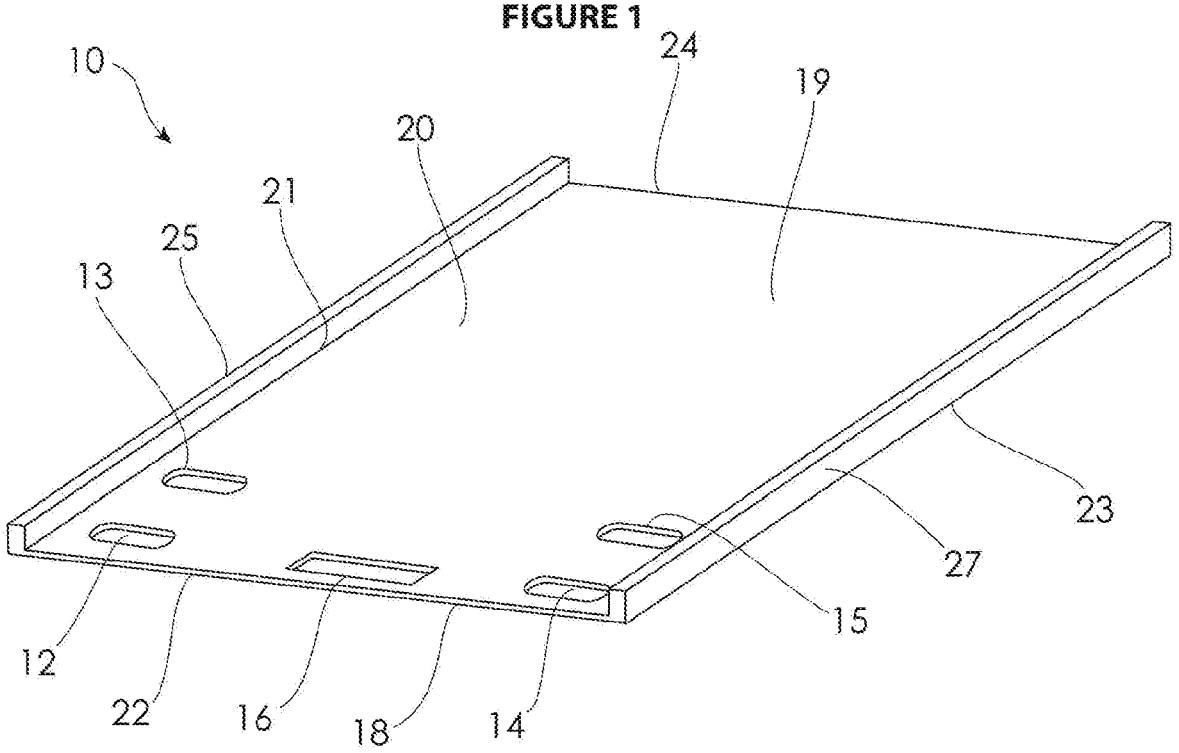
FIG. 2 illustrates a perspective view of the apparatus of FIG. 1 wherein the resiliently flexible sheet is forced into a conical form tapering in an axial direction from a larger diameter end to a smaller diameter end.

FIG. 2 illustrates an embodiment of the apparatus 10 of the present invention. The apparatus 10 includes a flexible sheet 20, preferably comprised of a resilient material, such as a resiliently flexible polymeric material which may be reinforced with nylon or some other flexible reinforcement. The material from which the flexible sheet 20 is formed is a high-density polyethylene (HDPE) composite, which may or may not be reinforced, with anti-static properties. The sheet 20 includes a pair of opposite surfaces 18, 19 and is preferably formed in a rectangular shape such that it includes a first pair of spaced apart and longitudinally extending parallel side edges 21, 23 and a second pair of spaced apart and laterally extending parallel end edges 22, 24. In the embodiment of FIGS. 1 to 5 the first pair of parallel side edges 21, 23 comprise elongated flanges 25, 27 extending along substantially the entire lengths thereof. It is to be appreciated that the second pair of parallel and spaced apart end edges 22, 24 need not necessarily be parallel. The sheet 20 includes a series of apertures 12, 13, 14, 15 that are arranged in laterally spaced apart and longitudinally aligned pairs 12, 14 and 13, 15. The sheet 20 includes a further aperture 16 located adjacent to one of the end edges 16 that functions as a handle.

Figure 3:
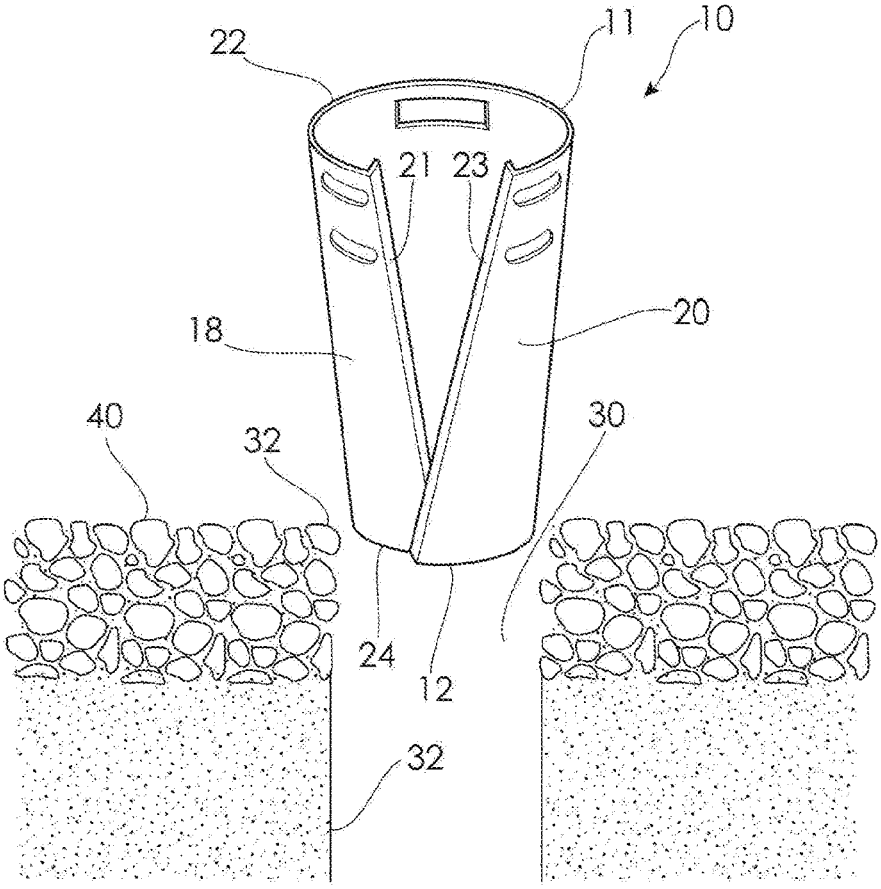
FIG. 3 illustrates a perspective view of the apparatus of FIG. 1, wherein the smaller diameter end is inserted through the open end of a blast hole.
Figure 4:
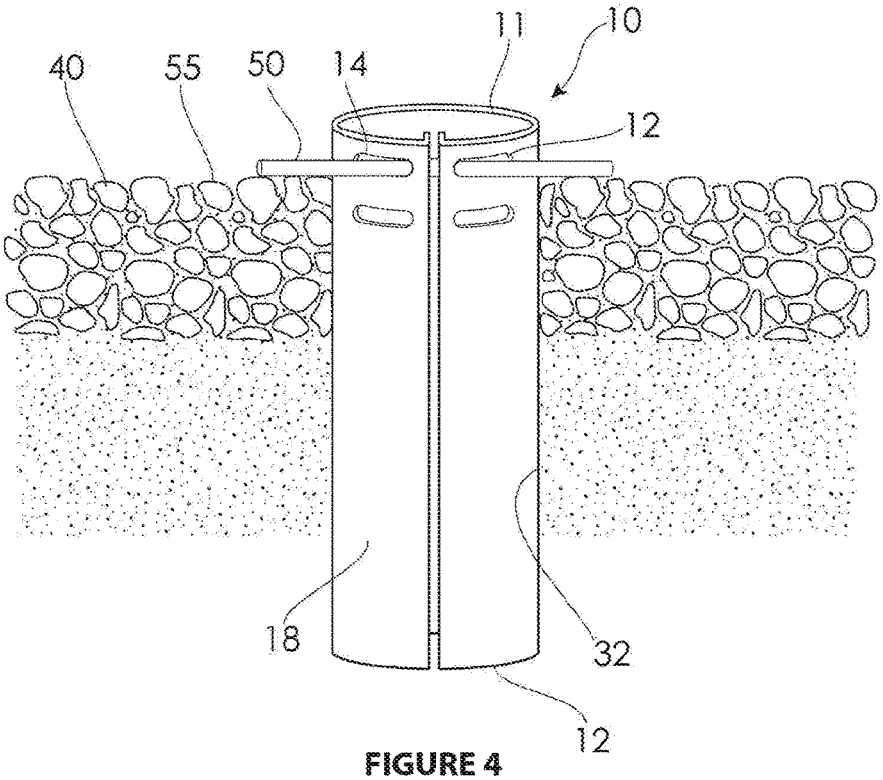
FIG. 4 illustrates a perspective view of the apparatus of FIG. 1, wherein after the smaller diameter end is inserted through the open end of a blast hole the sheet is released to assume a substantially cylindrical form coaxial with the blast hole thereby forming a barrier preventing surrounding loose rock fragments from falling into the blast hole.

FIGS. 3 and 4 illustrate the sheet 20 in use. As shown in FIG. 3, the sheet 20 is adapted to be forced from its resting flat form into a curved form, such as a cylindrical or conical form. The sheet 20 may be forced into the cylindrical or conical form by manually or mechanically bending the sheet 20. When the sheet 20 is in the cylindrical form or, as illustrated in FIG. 3, the conical form the sheet 20 defines a longitudinal passage tapering in an axial direction from a larger diameter end 11 defining a larger diameter opening to a smaller diameter end 12 defining a smaller diameter opening. The larger diameter end 11 is comprised of one of the end edges 22 closest to the series of apertures 12, 13, 14, 15. The smaller diameter end 12 is comprised of the other one of the end edges 24 furthest from the series of apertures 12, 13, 14, 15. The smaller diameter end 12 has an overall diameter that is smaller than the diameter of the open end 33 of the blast hole 30. The smaller diameter end 12 of the sheet 20, when it is in the conical form, is inserted first into the open end 33 of the blast hole 30.

Figure 5:
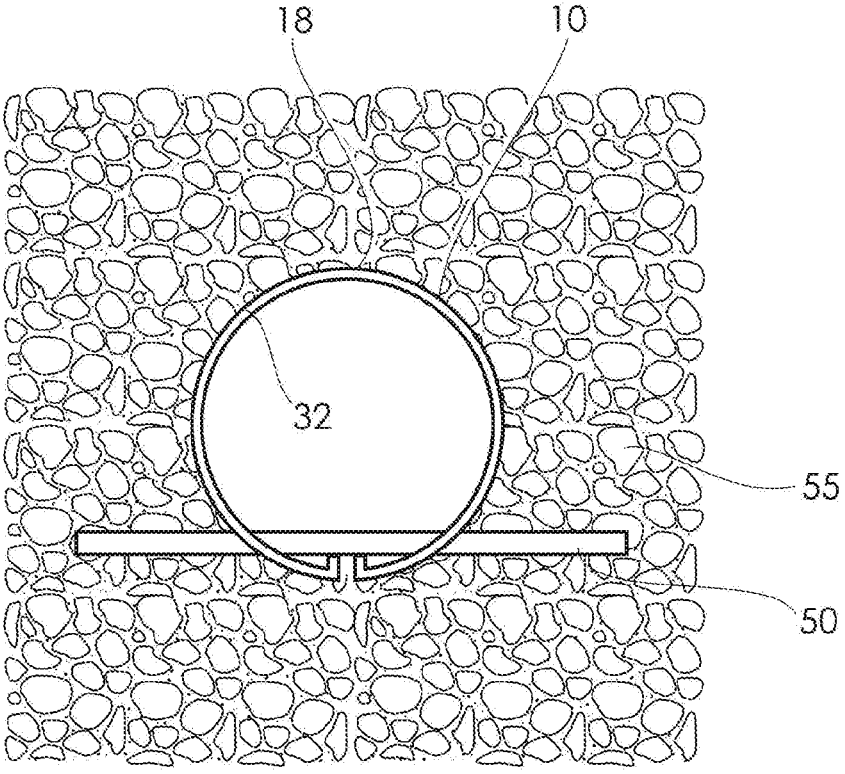
FIG. 5 illustrates a top view of the apparatus of FIG. 1, wherein elongated flanges along the opposite parallel edges are closely spaced apart and are adapted for abutment with each other.

After the smaller diameter end 12 of the sheet 20 is inserted into the open end 33 of the blast hole 30. The sheet 20 is then released so that the resilient properties of the material from which the sheet 20 is formed allow the sheet 20 to expand and, perhaps in conjunction with some manual manipulation, assume a substantially cylindrical form substantially coaxial with the blast hole 30. As illustrated in FIGS. 4 and 5, one of the opposite surfaces 18 of the sheet forms a cylindrical external, outwardly facing surface that faces an inwardly facing substantially cylindrical surface 32 of the blast hole 30.

Although the figures illustrate the sheet 20 being formed into a conical shape for insertion into the blast hole 30 it is to be appreciated that the sheet 20 may be formed into a substantially cylindrical shape defining a longitudinal passage extending between the longitudinally opposite ends 11, 12 thereof. The diameters of the ends 11, 12 may be substantially the same prior to insertion of one of the ends 11, 12 into the open end 33 of the blast hole 30. When the sheet 20 is released it may already be substantially cylindrical and coaxial with the substantially cylindrical surface 32 of the blast hole 30. The resilient properties of the material from which the sheet 20 is formed cause the external surface 18 to be biased against the internal surface 32 of the blast hole 30.

As illustrated in FIG. 4, the sheet 20 locates within the open end 33 of the blast hole 30 and forms a barrier preventing surrounding loose rock fragments 40 from falling or collapsing into the blast hole 30 at or near the open end 33 of the blast hole 30. As the layer of preconditioned rock fragments 40 can have a depth of up to four or more metres the sheet 20 helps to support the upper portion of the internal surface 32 of the blast hole 30 from collapsing. The longitudinal dimension of the sheet 20 between the longitudinally opposite end edges 22, 24 may be 1 metre, 1.5 metres, 2, metres, 2.5 metres, 3 metres, 3.5 metres, 4 metres or more in length or any length in between. The length of the sheet 20 is selected based on geological requirements. When positioned within the blast hole 30 the sheet 20 provides support for the internal surface 32 through a substantial portion of the preconditioned layer of rock fragments 40. The sheet 20 thereby forms a barrier preventing surrounding loose rock fragments 40, such as within the preconditioned layer, from falling or collapsing into the blast hole 30.

The width of the sheet 20 between the pair of parallel side edges 21, 23 is slightly less than the circumference of the inwardly facing substantially cylindrical surface 32 of the blast hole 30. When the sheet 20 assumes the substantially cylindrical form within the blast hole 30 the side edges 21, 23 of the sheet are spaced apart and do not overlap. In the embodiment of FIGS. 1 to 5, the elongated flanges 25, 27 are spaced apart a small distance and are adapted for abutment with each other to prevent the edges 21, 23 from sliding over one another. The elongated flanges 25, 27 prevent the circumference of the sheet 20, in its cylindrical form within the blast hole 30, from decreasing below a threshold. Put another way, the elongated flanges 25, 27 along the edges of the panel 20 are adapted to come into abutment to support the cylindrical structure of the sheet 20 and, hence support the external cylindrical surface 18 of the sheet 20 against the inwardly facing substantially cylindrical surface 32 of the blast hole 30 and loose rock fragments 40 at or near the open end 33 of the blast hole 30.

Each one of the apertures 12, 13, 14, 15 extends through the sheet 20 from the external surface 18 to the internal surface 19. An elongated rod member 50 can be inserted horizontally through a pair of the horizontally aligned apertures 12, 14 or 13, 15. Each pair of horizontally aligned apertures 12, 14, 13, 15 are located at different positions along the length of the sheet 20 so that a user can select a height of the sheet 20 within the blast hole 30. Opposite ends of the rod member 50 engage a surface 55 surrounding the open end 33 of the blast hole 30. The rod member 50 engages the pair of horizontally aligned apertures 12, 14 or 13, 15 and the surrounding surface 55 to prevent the sheet 30 from passing further into the open end 33 of the blast hole 30. As shown in FIG. 4, a small portion of the sheet protrudes from the open end 33 of the blast hole 30. The elongated rod member 50 functions to anchor the sheet 20 at or towards the open end 33 of the blast hole 30.

Figure 6:
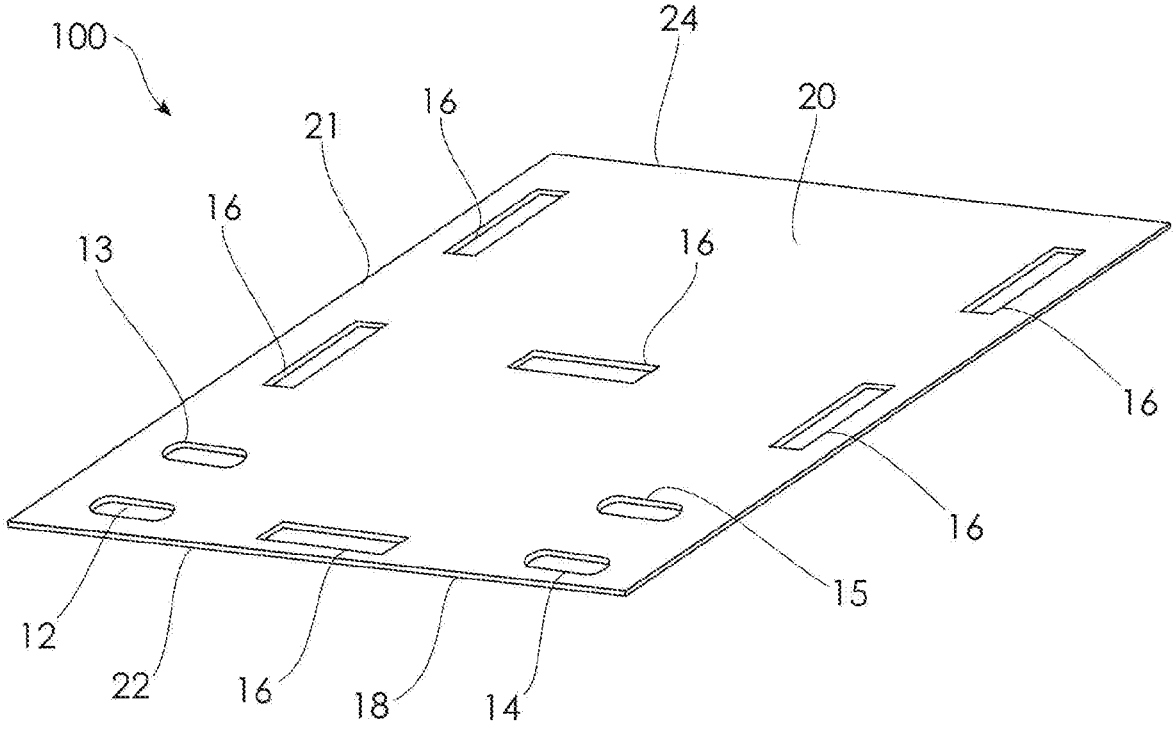
FIG. 6 illustrates a perspective view of an apparatus in accordance with another embodiment of the invention.

FIG. 6 illustrates another embodiment of the apparatus 100 which is like the embodiments of FIGS. 1 to 5 and functions in a similar fashion. Features of the apparatus of FIG. 6 that are structurally or functionally like, or are the same as, features of the embodiment of FIGS. 1 to 5 are represented by like reference numerals. The apparatus 100 includes a flexible sheet 20, preferably comprised of a sheet of resilient material such as a resiliently flexible polymeric material That may also be reinforced. The sheet 20 includes a pair of opposite surfaces 18, 19 and is preferably formed in a rectangular shape such that it includes a first pair of spaced apart and transversely opposite and longitudinally extending parallel side edges 21, 23 and a second pair of spaced apart and longitudinally opposite and transversely extending parallel end edges 22, 24. Unlike the embodiment of FIGS. 1 to 5, the embodiment of FIG. 6 has no elongated flanges along the first pair of parallel side edges 21, 23. It is to be appreciated that the pairs of edges 21, 23, 22, 24 need not necessarily be parallel. The sheet 20 includes a series of apertures 12, 13, 14, 15 that are arranged in laterally spaced apart and longitudinally aligned pairs 12, 14 and 13, 15. The sheet 20 includes several apertures 16 that act as handles or hand-holds allowing a user to manipulate the sheet 20 from a flat condition, as illustrated in FIG. 6, into a conical or cylindrical condition as illustrated in FIGS. 3, 4 and 5. The apertures 16 acts as a handle allow a user to manoeuvre the sheet 20 into and out of or relative to the open end 33 of the blast hole 30.

Although in the embodiment of the apparatus 100 of FIG. 6 the width of the sheet 20 between the longitudinally extending side edges 21, 23 less than the circumference of the blast hole 30 it is to be appreciated that in other embodiments the width may be equal to or greater than the circumference of the blast hole 30.

Figure 7:
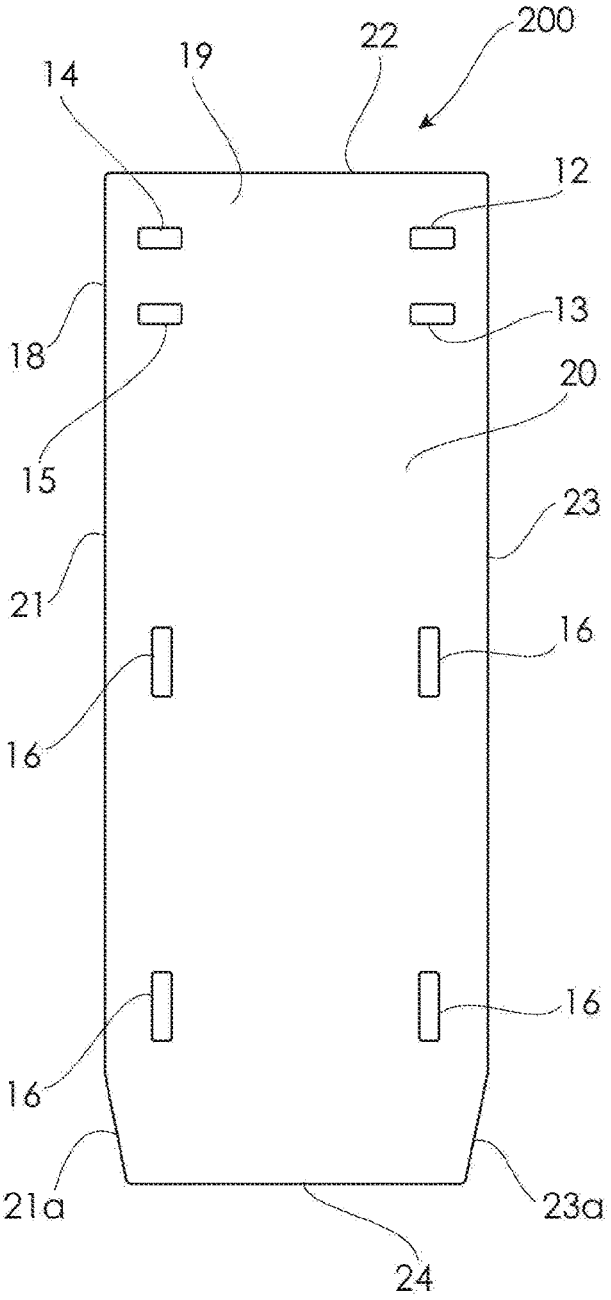
FIG. 7 illustrates a plan view of an embodiment of the invention including an apparatus for preventing surrounding loose rock fragments from falling or collapsing into a blast hole, wherein the apparatus includes a resiliently flexible substantially rectilinear sheet having pair of opposite substantially parallel edges wherein the edges taper at one end.
Figure 8:
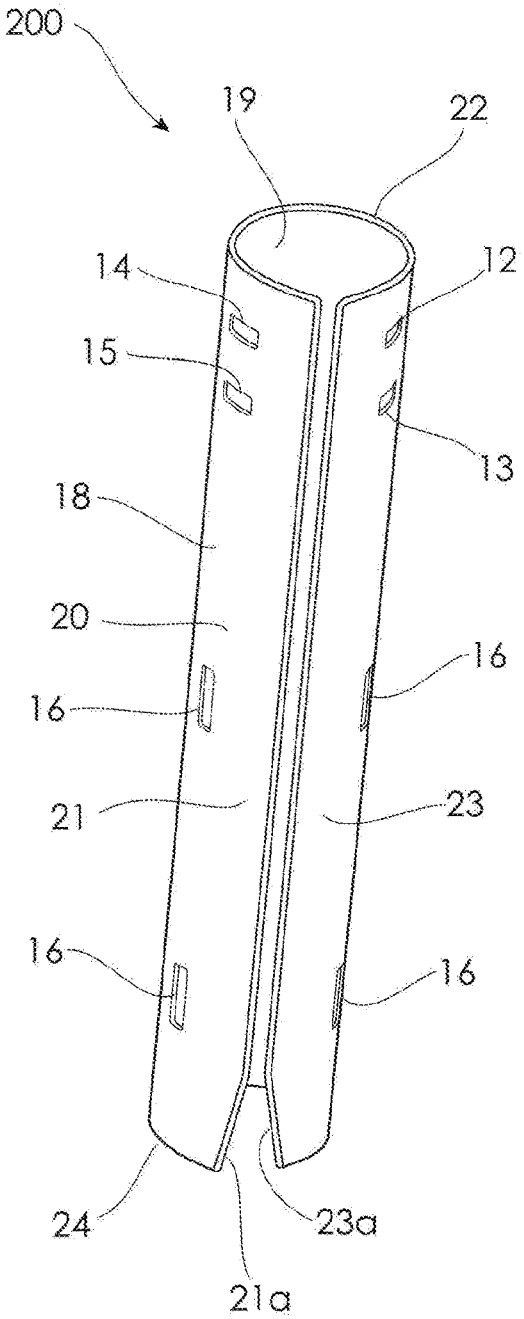
FIG. 8 illustrates a perspective view of the apparatus of FIG. 7 wherein the sheet is forced into a cylindrical form.

FIGS. 7 and 8 illustrate another embodiment of the apparatus 200 which is like the embodiments of FIGS. 1 to 6 and functions in a similar fashion. Features of the apparatus of FIGS. 7 and 8 that are similar or the same as features of the embodiment of FIGS. 1 to 6 are represented by like reference numerals. The apparatus 200 includes a flexible sheet 20, comprised of a sheet of resilient material such as a resiliently flexible polymeric material that is reinforced.

The sheet 20 includes a pair of opposite surfaces 18, 19 and is formed in a rectangular shape such that it includes a first pair of spaced apart and transversely opposite parallel side edges 21, 23 and a second pair of spaced apart and longitudinally opposite parallel end edges 22, 24. Unlike the embodiment of FIG. 6, in the embodiment of FIGS. 7 and 8 the transversely opposite parallel side edges 21, 23 are tapered at ends 21*a*, 23*a* thereof. The tapering of the ends 21*a*, 23*a* of the transversely opposite parallel side edges 21, 23 reduces outward flaring of the corners of the sheet 20 when the sheet 20 is forced, whether manually or otherwise, into a curved form, such as a cylindrical form as illustrated in FIG. 8. Accordingly, when the sheet 20 is bent over on itself and the transversely opposite parallel edges 21, 23 are brought towards each other the tapering of the ends 21*a*, 23*a* of the transversely opposite parallel edges 21, 23 promote a more uniform cylindrical form for the sheet 20. The distal end of the sheet 20 comprising the tapered ends 21*a*, 23*a* is adapted to be inserted first into the blast hole 30. Minimising outward flaring of the corners of the sheet 20 at the distal end thereof where the transversely opposite parallel edges 21, 23 and the longitudinally opposite parallel edges 22, 24 meet aids in ease of insertion of the sheet 20 into the blast hole 30.

In another aspect, the invention provides a method for preventing surrounding loose rock fragments 40 from falling or collapsing into the blast hole 30. The method includes a step of bending, such as by manually or otherwise forcing a resiliently flexible sheet 20, such as the sheet 20 of FIG. 2 or of FIG. 6, into a substantially cylindrical form or a conical form tapering in an axial direction from a larger diameter end to a smaller diameter end, such as is illustrated in FIG. 3. The method includes inserting one end of the sheet 20, which may be the smaller diameter end, through the open end of a blast hole 30, such as is shown in FIG. 3. The sheet 20 is then released, or may be manipulated, to assume a substantially cylindrical form coaxial with the blast hole 30 as illustrated in FIG. 4. The sheet 20 thereby forms a barrier preventing surrounding loose rock fragments from falling or collapsing into the blast hole 30 at or near the open end of the blast hole 30.

In another aspect, the invention provides a bench blasting method. The method includes drilling blast holes through a layer of preconditioned loose rock fragments 40 and into the stable rock below. The preconditioned layer 40 may be up to or more than 4 metres in depth. The method includes forming a substantially flat flexible sheet 20, such as the sheet 20 of FIG. 2 or of FIG. 6, into a curved form defining a longitudinal passage extending between openings at longitudinally opposite ends. The method further includes inserting one end of the curved sheet 20 into an open end of the blast hole 30 whereby the curved sheet 20 closely faces an internal surface 32 of the blast hole 30 within the layer of preconditioned loose rock fragments 40 and forms a barrier preventing the internal surface 32 of the blast hole 30 within the preconditioned layer of loose rock fragments 40 from falling or collapsing into the blast hole 30.

The methods can include forcing the flexible sheet 20 into a conical form tapering in an axial direction from a larger diameter opening at one of the ends to a smaller diameter opening at the other end, inserting the smaller diameter end through the open end of a blast hole 30, and releasing the sheet 20 to assume a substantially cylindrical form within the blast hole 30. Alternatively, the method can involve forcing the flexible sheet 20 into a substantially cylindrical form and inserting one end through the open end of the blast hole 30 down to a desired depth. An elongated rod 50 can then be inserted through apertures 12, 14, 13, 15 within the sheet 20. The elongated rod 50 engages the surface surrounding the blast hole 30, as illustrated in FIG. 3, to maintain the sheet 20 at the opening into the blast hole.

Preferably, the sheet 20 has a longitudinal length dimension that is 1 metre, 1.5 metres, 2 metres, 2.5 metres, 3 metres, 3.5 metres, 4 metres or more or any length therebetween. The length of the sheet 20 is selected based on geological requirements. Preferably, the methods include inserting the curved sheet 20 into the open end of the blast hole 30 whereby the curved sheet 20 closely faces an internal surface 32 of the blast hole 30 down to a depth of about 1 metre, about 1.5 metres, about 2 metres, about 2.5 metres, about 3 metres, about 3.5 metres, about 4 metres or more or any depth therebetween within the layer of preconditioned loose rock fragments 40.

The sheet 20 may remain in position within the blast hole 30 during a subsequent step of depositing explosives and other consumables into the blast hole 30. In embodiments of the methods, the sheet 20 may remain in the cylindrical form or may be manipulated into a conical form, such as by bending the sheet 20 into the conical form, as illustrated in FIG. 3, such that the sheet 20 may operate as a funnel through which explosives and other consumables may be deposited into the blast hole 30.

In embodiments of the methods, the user selects a desired height for the sheet 20 that is located within the blast hole 30 by locating the elongated rod member 50 through a desired pair of apertures 12, 14, 13, 15. After the sheet 20 is inserted into the blast hole 30 the elongated rod member 50 rests on the surface 55 surrounding the blast hole 30. The apertures 12, 14, 13, 15 are positioned such that upon insertion of the elongated rod 50 therethrough, the elongated rod 50 is offset from the central axis of the longitudinal passage extending through the curved sheet 20 to facilitate insertion into the blast hole 30 of lining material, loading with explosive, priming and providing any other consumables into the blast hole 30. The sheet 20 can then be partially withdrawn and formed into a funnel shape prior to depositing of stemming material into the blast hole 30. The sheet 20 may be removed from the blast hole 30 to assume a flat form for storage.

Figure 9:
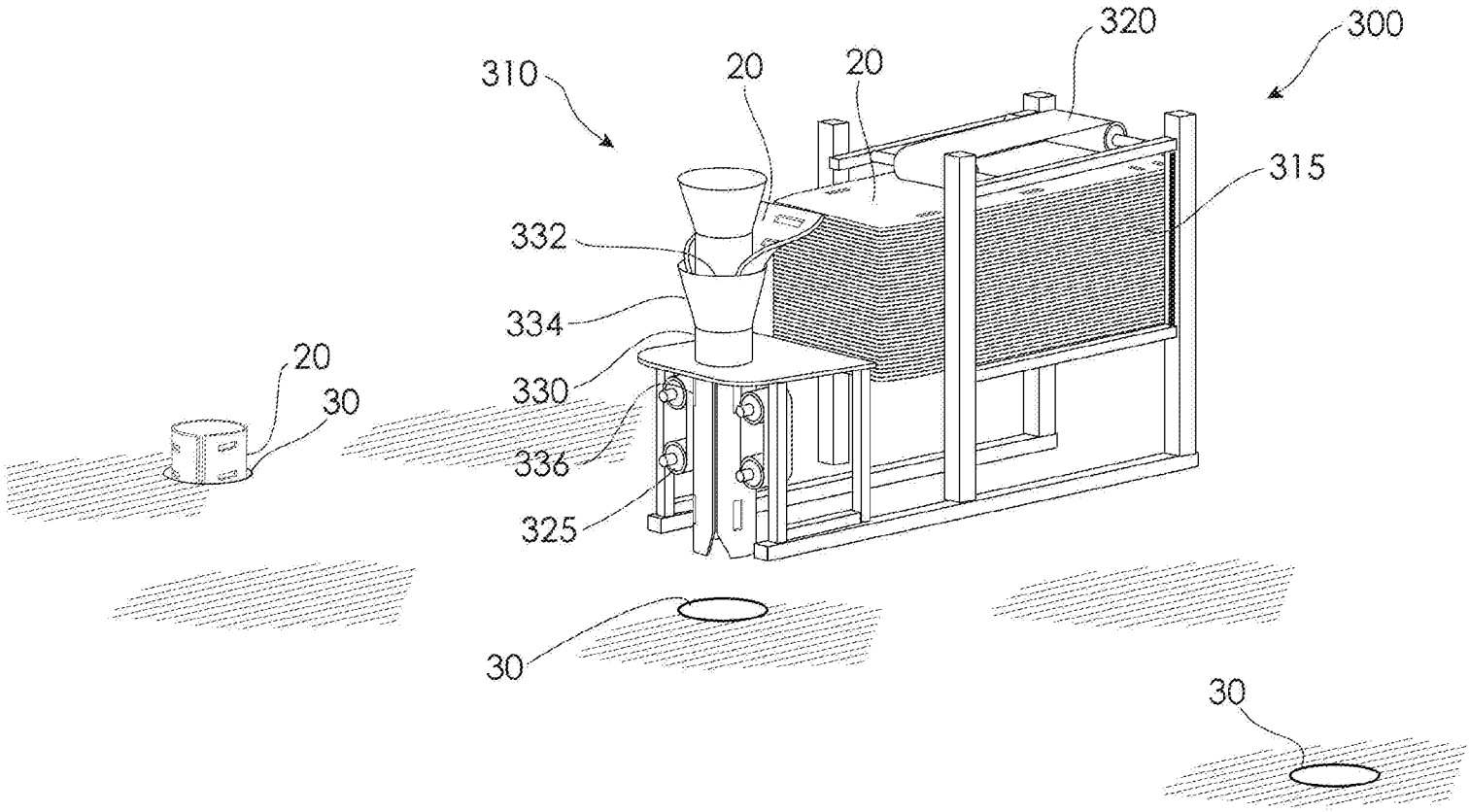
FIG. 9 illustrates an apparatus for deploying the sheet of any of the embodiments of FIGS. 1 to 8 into the blast hole.

FIG. 9 illustrates a deployment device 300 for deploying the sheet 20 into the blast hole 30. The device 300 includes a forming apparatus 310 adapted to form the flat flexible sheet 20 into a curved form for insertion into the open end of the blast hole 30 whereby the curved sheet closely faces the internal surface of the blast hole 30 and forms a barrier preventing surrounding loose rock fragments from falling or collapsing into the blast hole 30.

The deployment device 300 includes a plurality of the sheets 20 of FIG. 6 arranged in a stack 315. The device 300 includes a sheet picker 320 and feeder 325 that is operable to pick an individual sheet 20 from the stack 315 and feed the sheet 20 to a vertical forming apparatus 330. In the embodiment illustrated in FIG. 9, the picker 320 and the feeder 325 are comprised of an arrangement of driven belts operable to pick one of the sheets 20 at a time from the stack 315. However, any mechanical arrangement that is adapted to pick one sheet 20 from the stack 315 and feed the sheet 20 to the vertical forming apparatus 330 may constitute another embodiment of the invention. The forming apparatus 330 is operable to form the sheet 20 into a curved form defining a longitudinal passage extending between openings at longitudinally opposite ends. The forming apparatus 330 includes a vertically oriented shaped passage 332 with a wide opening at the top 334 and side walls tapering towards a narrower bottom outlet 336. However, any mechanical arrangement that is adapted to form the sheet 20 into a curved form defining a longitudinal passage extending between openings at longitudinally opposite ends may constitute another embodiment of the invention.

The outlet 336 of the forming apparatus 330 is adapted to be manually or automatically located over or to some extent into the open end of a blast hole 30. The sheet picker 320 and feeder 325 are operable to drive the individually picked sheet 20 through the passage 332 and through the outlet to thereby feed the curved sheet 20 into the open end of a blast hole 30. The forming apparatus 330 is operable to continue feeding the sheet 20 to a desired depth within the blast hole 30 and releases the sheet 20 when it has reached a predetermined depth. The released sheet 20, which has a substantially cylindrical form coaxial with the blast hole 30 as in FIG. 4, thereby forms a barrier preventing surrounding loose rock fragments from falling or collapsing into the blast hole 30.

The deployment device 300 may be mounted to a vehicle (not shown) or a trailer (not shown) coupled to a vehicle or any other mobile apparatus adapted to be manoeuvred around a site comprising a plurality of blasting holes 30 that have previously been drilled. The vehicle or other mobile apparatus may be a truck that is operable manually by a driver or in an embodiment is configured to operate autonomously or semi-autonomously. The vehicle or other mobile apparatus may comprise a control module that includes a GPS location device and is adapted for controlling a drive means and steering means of the vehicle. The control module is adapted to receive or be programmed with the coordinates of the location of one or more of a plurality of blast holes and to autonomously manoeuvre the deployment device 300 to a location adjacent a first one of the blast holes.

When located adjacent the first blast hole 30, the control module may autonomously operate the deployment device 300 to deploy one of the sheets 20 into the blast hole 30. The control module may cause the outlet of the deployment device 300 to locate over the blast hole using the coordinates of the blast hole or using imagery from a camera mounted to the device 300 or the vehicle 350 or a combination of both. The control module may autonomously or semi-autonomously activate the sheet picker 320 and feeder 325 to drive the sheet 20 through the forming apparatus 330 and through the outlet 336 to thereby feed the curved sheet 20 into the open end of a blast hole 30.

The control module may cause the deployment device 300, vehicle, trailer or other mobile apparatus to autonomously manoeuvre to a location adjacent the next blast hole for subsequent autonomous or semi-autonomous sheet 20 deployment. The control module may cause the platform to autonomously or semi-autonomously carry out sheet deployment across an array of blast holes.

Although the disclosure has been described with reference to specific examples, it will be appreciated by those skilled in the art that the disclosure may be embodied in many other forms, in keeping with the broad principles and the spirit of the disclosure described herein.

The invention claimed is:

1. A method to prevent loose rock fragments from falling into a blast hole, comprising the steps of:

providing a resiliently flexible sheet including a pair of spaced apart longitudinally extending side edges and a pair of spaced apart laterally extending end edges, the sheet having a curved form defining a longitudinal passage extending between openings at longitudinally opposite ends, one end of the curved sheet being insertable into the open end of a blast hole;

forming the sheet into a curved form defining a longitudinal passage extending between openings at longitudinally opposite ends;

inserting one end of the curved sheet into the open end of a blast hole wherein in the curved form the side edges of the sheet are free and the sheet biases towards a flat form whereby an external surface of the curved sheet biases against an internal surface of the blast hole substantially coaxially therewith forming a barrier preventing surrounding loose rock fragments from falling or collapsing into the blast hole; and inserting an elongated member through one or more apertures in the sheet whereby the elongated member engages a surface surrounding the blast hole to prevent further insertion of the sheet through the open end of the blast hole.

2. The method of claim 1 wherein forming the sheet into a curved form includes rolling the sheet from a normally flat form into the curved form.

3. The method of claim 1 including: forcing the flexible sheet into a cylindrical or conical form;

inserting the sheet through the open end of a blast hole; and releasing the sheet to assume a substantially cylindrical form within the blast hole.

4. The method of claim 1, wherein the sheet has a longitudinal length dimension that is between 1 meter and 2.5 meters.

5. The method of claim 1, wherein the curved sheet is inserted into the open end of the blast hole whereby the curved sheet closely faces an internal surface of the blast hole down to a depth of between about 1 meter and about 2.5 meters within the layer of preconditioned loose rock fragments.

6. The method of claim 1, including partially withdrawing the sheet from within the blast hole prior to loading explosive into the blast hole.

7. The method of claim 1, including removing the sheet from the blast hole to assume a flat form for storage.

* * * * *